US005601016A

United States Patent [19]

Witte

[11] Patent Number: 5,601,016

[45] Date of Patent: Feb. 11, 1997

[54] ADJUSTABLE SHELF SYSTEM AND METHOD

[76] Inventor: Walter Witte, 3267 NW. 123rd Ave., Sunrise, Fla. 33323

[21] Appl. No.: 481,075

[22] Filed: Jun. 7, 1995

[51] Int. Cl.[6] ..... A47B 9/00

[52] U.S. Cl. ..... 108/106; 211/117; 108/42

[58] Field of Search ..... 108/42, 193, 180, 108/106, 109; 211/94, 113, 117, 162, 90; 248/317

[56] References Cited

U.S. PATENT DOCUMENTS

| | | | |
|---|---|---|---|
| 3,848,844 | 11/1974 | Barrett | 108/106 X |
| 3,923,161 | 12/1975 | Kaiser et al. | 211/117 |
| 4,108,084 | 8/1978 | Fink | 211/117 X |
| 4,311,243 | 1/1982 | Hui-Lai | 211/113 |
| 4,595,106 | 6/1986 | Kunze et al. | 211/162 X |
| 4,869,379 | 9/1989 | Hawkrige | 211/94 X |
| 5,020,677 | 6/1991 | Wirth et al. | 211/113 |
| 5,076,446 | 12/1991 | Simmerman et al. | 211/113 |
| 5,088,609 | 2/1992 | Frye | 211/117 |
| 5,147,050 | 9/1992 | Cullen | 211/117 X |

*Primary Examiner*—Jose V. Chen
*Attorney, Agent, or Firm*—Frank L. Kubler

[57] ABSTRACT

A suspended shelf system for securing to an elevated structure for retaining various items includes a system mounting track member and fastener elements for securing the track member to the elevated structure, at least two suspension members, each having a suspension member mounting end with track member engaging structures for securing each suspension member to the track member, so that each suspension member hangs substantially vertically from the track member, and so that the suspension members are spaced apart from each other, and at least one connecting rail having two connecting rail ends, each connecting rail end a including suspension member engaging structure, for mounting substantially horizontally between and engaging the spaced apart suspension members for retaining item hangers and shelf structures. A method is provided of assembling the above-described shelf system into a space and to an elevated structure for retaining various items, including the steps of selecting the dimensions of a space into which the shelf system is to be assembled, fastening the track member to the elevated structure, securing the suspension member mounting ends to the track member so that the suspension members are spaced apart from each other, selecting a desired elevation for a connecting rail in view of types of items to be retained, positioning the connecting rail substantially horizontally between the suspension members, and securing the connecting rail ends to the suspension members with the member engaging structure.

18 Claims, 5 Drawing Sheets

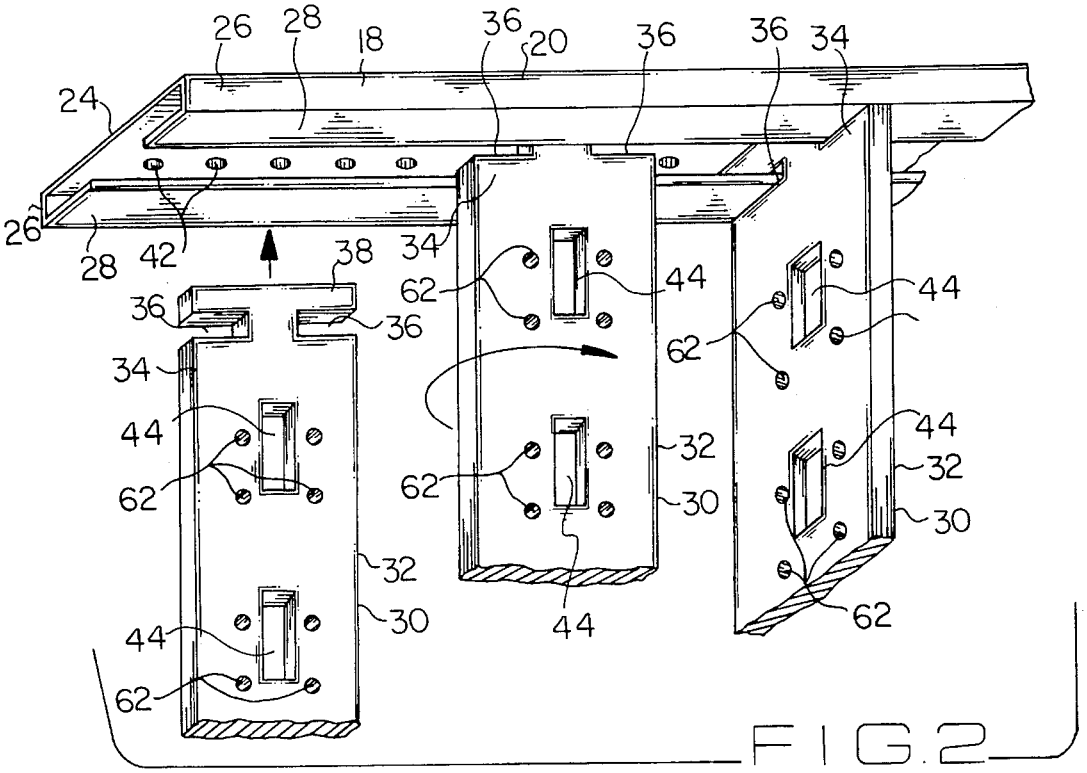
FIG. 2
FIG. 2A
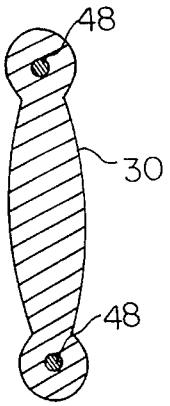
FIG. 2B
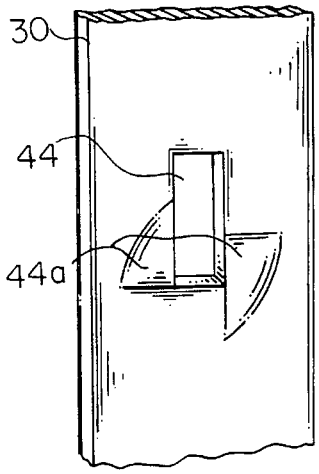

ADJUSTABLE SHELF SYSTEM AND METHOD

BACKGROUND OF THE INVENTION

1. Field of the Invention

The present invention relates generally to the field of shelving and storage structures. More specifically, the present invention relates to a shelf system which is adjustable in size and configuration for assembly with minimal skill, hardware and tools inside closets and various other interior locations, for retaining and supporting items of various types and sizes. The basic shelf system includes a mounting track which is fastened substantially horizontally to the underside of an elevated structure such as a ceiling. At least one, and preferably at least two, elongate suspension members engage the track at member engaging ends and hang downwardly from the track, and are spaced apart from each other. At least one connecting rail is laterally secured horizontally between the suspension members for supporting coat hangers or shelf structures. Where the rails are long enough to require additional support at their mid-sections, support means are provided such as mounting strap assemblies which are anchored to the track or to the rail immediately above the given rail, and are tied around the given rail. Wall anchoring means are used for supporting shelves.

A method of assembling the shelf system is also provided. The user evaluates the dimensions of the space into which the system is to be assembled. The track is fastened to the ceiling of the space or to some other elevated structure. The engaging ends of the two suspension members are each secured into the track. The user selects the height desired for a rail, and the rail is secured between the suspension members at this height. The user considers whether the rail is to support clothing on hangers or free standing items. If the rail is to support clothing on hangers, the user places the hooks of the hangers over the rail and hangs the cloths. If the rail is to support free standing items, the user engagingly fits a channel portion of a shelf structure around the rail. Finally, wall anchoring means are secured to the shelf and to a building wall. A tie rack or other accessory is optionally fitted to the system.

2. Description of the Prior Art

There have long been shelf structures for assembly within buildings for various purposes. These structures have alternatively been expensive, complicated to assemble, not suited for convenient disassembly, bulky, and not adaptable to shelf locations of varying dimensions and to various types storage items. Some must be installed when the building is constructed.

Kern, U.S. Pat. No. 4,307,547, issued on Dec. 29, 1981, teaches a suspended shelving storehouse apparatus. Kern includes a storehouse foundation and two spaced apart vertical columns rising from the foundation which support a load-bearing storehouse ceiling. A series of vertical tension bars are provided between the vertical columns and are secured at their top ends to the load-bearing ceiling and at their bottom ends to the foundation. Shelving girders are secured horizontally between the tension bars. A problem with Kern is that it must be constructed as part of a storehouse, and is not designed for placement within an existing structure. Another problem with Kern is that the structure is not readily removable after assembly. Still another problem is that the materials and assembly are expensive and require skilled labor.

Ferdinand, U.S. Pat. No. 3,603,274, issued on Sep. 7, 1971, discloses a modular adjustable wall shelving apparatus. Ferdinand includes a pair of upright elongate mounting members similar to conventional shelf wall braces which are secured to a building wall with fasteners. The mounting members have longitudinal channels recessed into their front faces and a series of slots are provided within and along the length of each channel. Cantilever shelf support brackets are provided, each having an engaging end with an upwardly curved hook portion for fitting into a slot and a channel abutting portion below the hook portion. Shelves are placed across support brackets of like elevation. The weight of the support bracket, shelf and any items resting on the shelf hold the curved hook portion engagingly within its slot. A problem with Ferdinand is that no provision is made for retaining items not suited to shelf storage, such as dress shirts, suits and ties. Another problem with Ferdinand is that the upright mounting braces must carry substantial loading because of the cantilever connection of the shelf support brackets, and therefore must be made of relatively expensive, strong material rather than of an ordinary plastic.

Hoop, U.S. Pat. No. 4,315,611, issued on Feb. 16, 1982, reveals a device for suspending articles from a ceiling or the like. Hoop includes a mounting plate having a central port through which a fastener secures the plate to a hanger hook member, and having two opposing flanges doubling over the top of the plate to engage the edges of a drop ceiling frame member. A problem with Hoop is that only a certain few types of items can be conveniently hung from a hook. No provision is made for retaining shelf items. Another problem with Hoop is that a hook and mounting plate apparatus would probably have to be provided for each and every item to be retained.

Gast, U.S. Pat. No. 5,337,905, issued on Aug. 16, 1994, teaches a hanger assembly and system for assembling a modular closet organizer. Vertical partitions are provided, are spaced apart from each other, and include two or more vertical series of mounting holes. A top panel is secured across the top ends of the vertical partitions and a bottom panel is secured across the bottom ends of the vertical partitions for structural integrity. Shelf brackets, and drawer roller tracks, are secured to the mounting holes and shelves or drawers supported on these brackets and tracks extend between the vertical partitions. A hanger rod guide sleeve may be secured to the mounting holes and a hanger rod may be fit into and protrude from the guide sleeve for engaging and supporting a hanging item. A problem with Gast is that it occupies substantial floor space which may be needed for other purposes. Another problem with Gast is that the system has many separate parts which makes system assembly time consuming and which increases the chances of part loss. Another problem is that a separate hanger structure must be provided for each hanging item. Another problem is that the vertical partitions, and top and bottom panels, make the system wide, bulky and heavy. Still another problem is that the length of shelves is adjustable only within the limits of the length of the top and bottom panels provided with the system. Still another problem is that no provision is made to prevent bowing and sagging of long shelves.

Bohannan, U.S. Pat. No. 4,407,476, issued on Oct. 4, 1983, discloses a shelf and a hanger bar of selectable length for mounting in a closet. The shelf and bar are supported at each end by closet walls secured to opposing closet walls and a middle bracket secured into a third closet wall. A problem with Bohannan is that providing additional shelves or hanger bars requires bolting duplicate assemblies to closet walls, making installation and removal time consuming and substantially marring the closet walls. Changing shelf and bar spacing would require complete disassembly and screwing of brackets to walls still more locations. Another problem is that opposing walls may not always be present or accessible.

Jeandel, et al, U.S. Pat. No. 5,174,200, issued on Dec. 29, 1992, reveals a shelving system including four upright system. Still another problem is that no provision is made to prevent bowing and sagging of long shelves.

Bohannan, U.S. Pat. No. 4,407,476, issued on Oct. 4, 1983, discloses a shelf and a hanger bar of selectable length for mounting in a closet. The shelf and bar are supported at each end by closet walls secured to opposing closet walls and a middle bracket secured into a third closet wall. A problem with Bohannan is that providing additional shelves or hanger bars requires bolting duplicate assemblies to closet walls, making installation and removal time consuming and substantially marring the closet walls. Changing shelf and bar spacing would require complete disassembly and screwing of brackets to walls still more locations. Another problem is that opposing walls may not always be present or accessible.

Jeandel, et al, U.S. Pat. No. 5,174,200, issued on Dec. 29, 1992, reveals a shelving system including four upright members functioning as support legs and shelves secured between the members with special connecting structures call riders. A problem with Jeandel, et al., is that the system occupies floor space and thus may displace something else kept in that space. Another problem is that the connecting structures are complex and would be relatively expensive to manufacture.

Gollick, U.S. Pat. No. 5,279,232, issued on Jan. 18, 1994, teaches a modular shelving interconnection assembly. Gollick includes two substantially upright, spaced apart side panels with holes extending through their lateral surfaces at approximately equal distances from their bottoms. Tabs of shelf support units extend through the side panel holes. Pegs in the shape of split, truncated cones extend through holes in the tabs on the outer side of the panels, and cooperate with the holes in the tabs and the outside surfaces of the panels to secure the shelf-support units to the panels. The problems of Jeandel, et al., are again presented.

It is thus an object of the present invention to provide a shelf system which may be constructed in any of numerous sizes and configurations to efficiently fit within a particular space such as part of a closet and to retain specific types of items or combinations of types of items.

It is another object of the present invention to provide such a shelf system which can be assembled, disassembled, removed and altered with minimal skill and with minimal use of tools and wall marring fasteners.

It is another object of the present invention to provide such a shelf system which does not require an adjacent building wall or partition for support.

It is still another object of the present invention to provide such a shelf system which locks together to form a very sturdy structure and yet is assembled and disassembled with maximum speed and ease.

It is still another object of the present invention to provide such a shelf system which is anchored at its top end for maximum stability, and which does not contact the floor so that floor space is saved for other uses.

It is finally an object of the present invention to provide such a shelf system which may be extruded of inexpensive and lightweight plastic, which is otherwise inexpensive to manufacture, and which may be compactly stored when disassembled.

SUMMARY OF THE INVENTION

The present invention accomplishes the above-stated objectives, as well as others, as may be determined by a fair reading and interpretation of the entire specification.

A suspended shelf system is provided for securing to an elevated structure for retaining various items, including a system mounting track member and fastener elements for securing the track member to the elevated structure, at least two suspension members, each having a suspension member mounting end with track member engaging structures for securing each suspension member to the track member, so that each suspension member hangs substantially vertically from the track member, and so that the suspension members are spaced apart from each other, and at least one connecting rail having two connecting rail ends, each connecting rail end a including suspension member engaging structure, for mounting substantially horizontally between and engaging the spaced apart suspension members for retaining item hangers and shelf structures. The track member preferably includes an elongate channel portion having a track channel top wall, two spaced apart track channel side walls extending longitudinally along and downwardly from the track channel top wall, and two opposing track channel retaining flanges spaced apart from and substantially parallel with the track channel top wall and extending generally toward each other from the track channel side walls. Each suspension member preferably includes an elongate strip, the strip having two opposing notches removed to form a T-portion at the suspension member mounting end, the T-portion being sized to fit within the track member between the track channel retaining flanges and the track channel top wall. Each suspension member additionally preferably includes several connecting rail mounting ports recessed in a longitudinal series along the length of each suspension member for receiving the suspension member engaging structure. Each connecting rail preferably includes an elongate member having a cross-shaped cross-section for minimal bowing under lateral loading, the cross-section being formed of two intersecting cross portions. Each connecting rail preferably has two rail ends, and each suspension member engaging structure preferably includes a flat rail end segment extending longitudinally from one of the cross-portions, and where each flat end includes a pair of opposing rail notches which define a rail T-portion at the rail end for engaging the rail mounting ports in the suspension members. Each rail notch is preferably sized to closely fit around the thickness of one of the suspension members at connecting rail mounting ports. The shelf system preferably additionally includes at least one shelf structure, each shelf structure including a shelf mounting portion having a substantially U-shaped shelf channel having a shelf channel connecting wall and a shelf channel upper side wall and a shelf channel lower side wall, the shelf channel upper side wall being sized in width to form a shelf surface for retaining at least one item, the shelf channel upper and lower side walls being spaced apart a certain distance substantially matching the width of the rail member, so that the shelf channel fits snugly and engagingly around the connecting rail and is retained on the connecting rail by friction. The shelf system further preferably additionally includes a connecting rail linking support structure for linking the connecting rail to the track member above the connecting rail to prevent the connecting rail from sagging. The connecting rail linking support structure preferably includes a mounting strap assembly including a mount member for engagingly fitting into the track member, and a hanger support strap extending from the mount member for securing around the connecting rail. The shelf system preferably additionally includes a tie retaining rack having an elongate strip member with a suspension member engaging structure and having a longitudinal series of tie retaining pegs protruding from the elongate strip.

A method is provided of assembling the above-described shelf system into a space and to an elevated structure for retaining various items, including the steps of selecting the dimensions of a space into which the shelf system is to be assembled, fastening the track member to the elevated structure, securing the suspension member mounting ends to the track member so that the suspension members are spaced apart from each other, selecting a desired elevation for a connecting rail in view of types of items to be retained, positioning the connecting rail substantially horizontally between the suspension members, and securing the connecting rail ends to the suspension members with the suspension member engaging structure. The method may include additional step of selecting the types of items to be retained by the shelf system, and further additional steps of placing the hook portion of an item hanger over the connecting rail and hanging at least one item on the item hanger. A further method step is optionally provided including fitting the shelf channel around the connecting rail so that the shelf channel upper side wall is substantially horizontal, to mount the shelf structure on the connecting rail.

BRIEF DESCRIPTION OF THE DRAWINGS

Various other objects, advantages, and features of the invention will become apparent to those skilled in the art from the following discussion taken in conjunction with the following drawings, in which:

FIG. 2 is a perspective partial view of the mounting track and the upper ends of three suspension members, which may be viewed in a left to right sequence showing suspension member insertion into, rotation relative to, and resulting mounting in the track, or may be viewed in a right to left sequence showing suspension member rotation and resulting removal from the track.

FIG. 2*a* is a cross-sectional view of suspension member showing the preferred cross-sectional shape for resistance against member buckling.

FIG. 2*b* is partial side view of a suspension member having the preferred recesses on either side of the mounting ports.

DETAILED DESCRIPTION OF THE PREFERRED EMBODIMENTS

Figure 1:
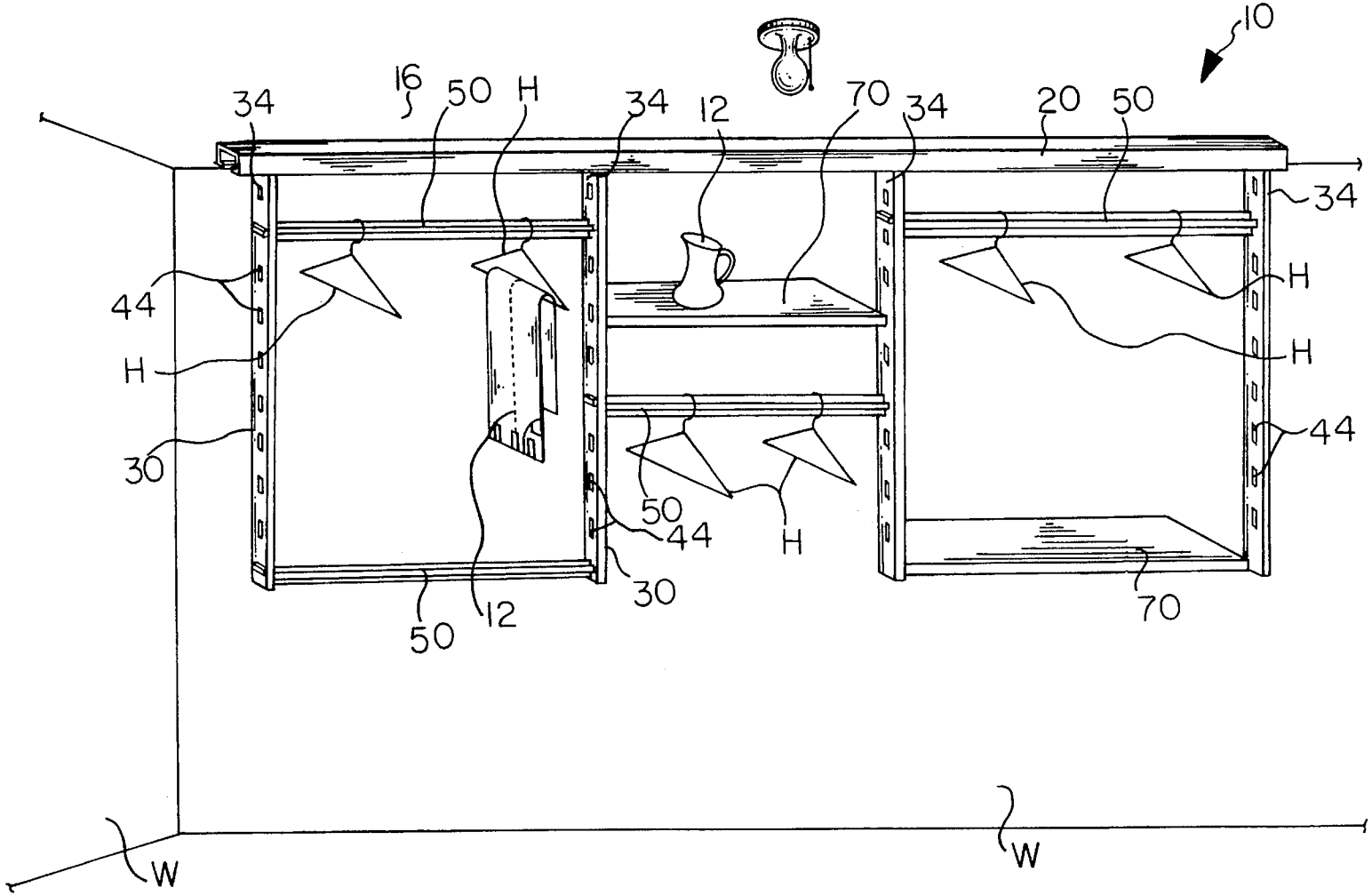
FIG. 1 is a representative perspective view of the assembled shelf system taking one of many possible system configurations.
Figure 3:
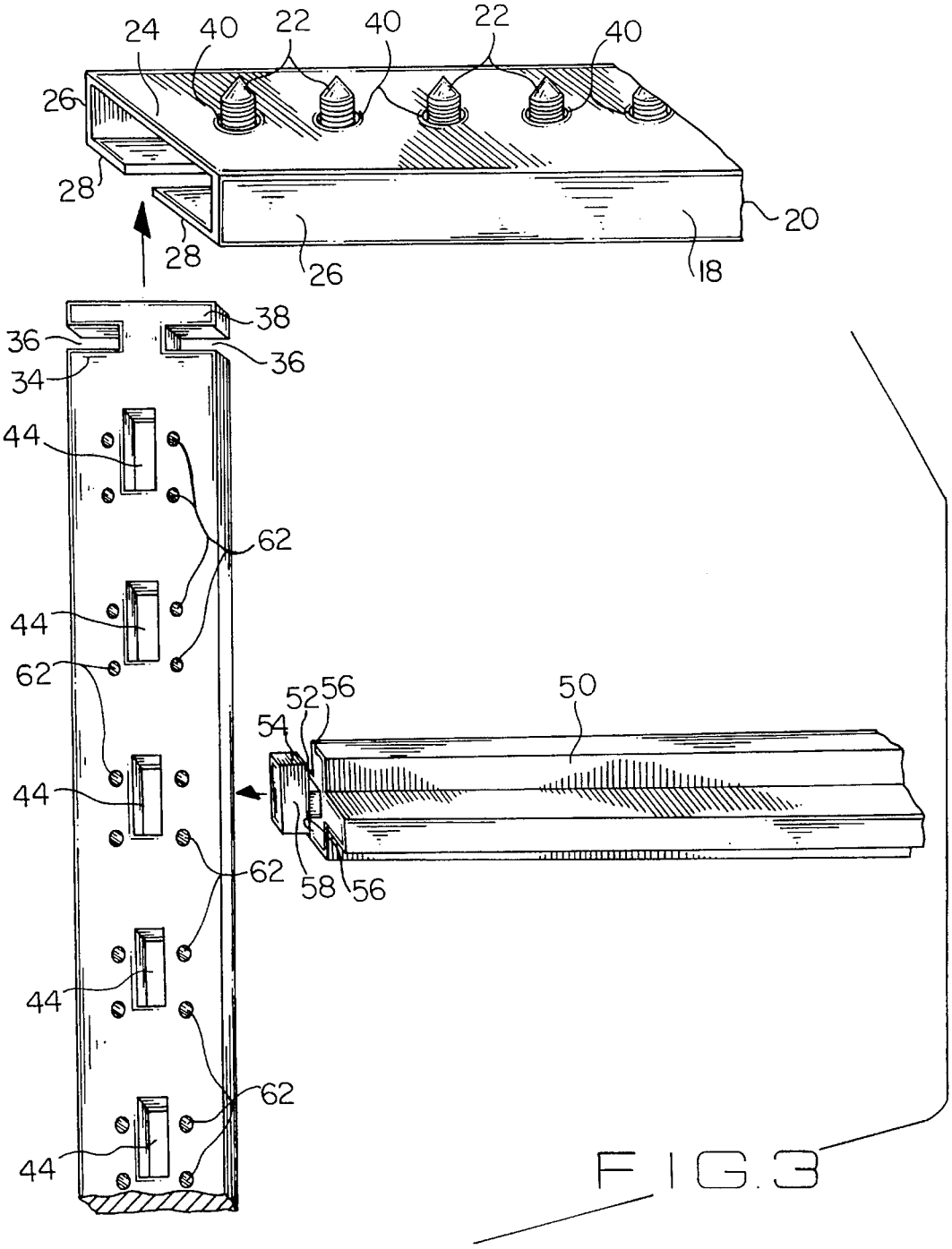
FIG. 3 is disassembled perspective partial view of the mounting track showing track fasteners protruding from the track upper surface, and of a suspension member and a connecting rail.
Figure 8:
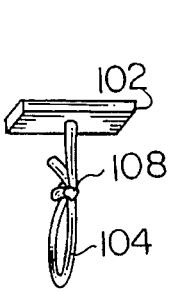
FIG. 8 is a perspective view of the preferred rail connecting structure for supporting long rails against bowing.
Figure 4:
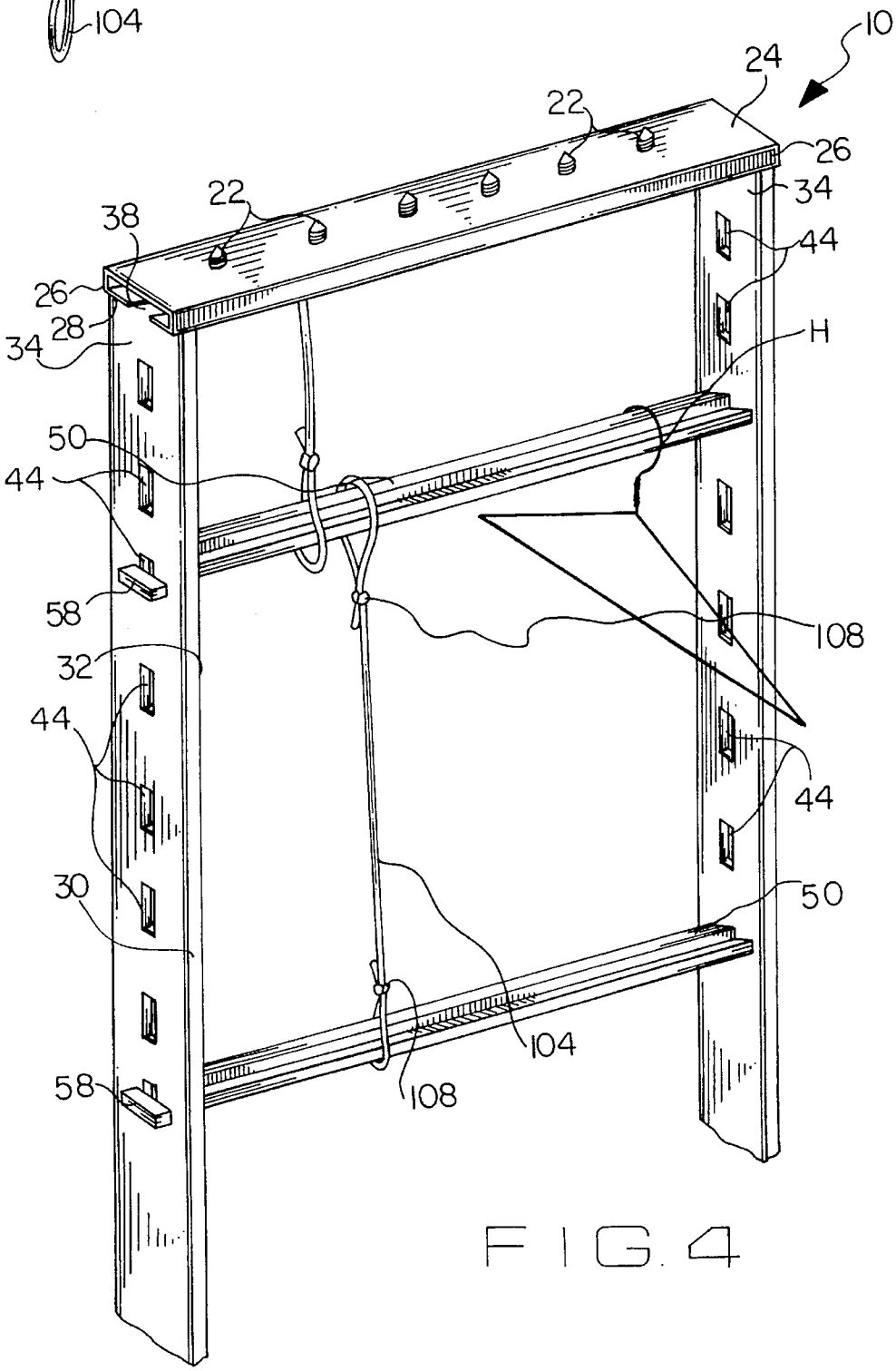
FIG. 4 is a perspective view of another configuration of the shelf system, showing connecting rail connecting structures. This FIGURE is merely illustrative of the relationships of the assembled parts and it is understood that the connecting structures would normally be used to support much longer rail spans.
Figure 5:
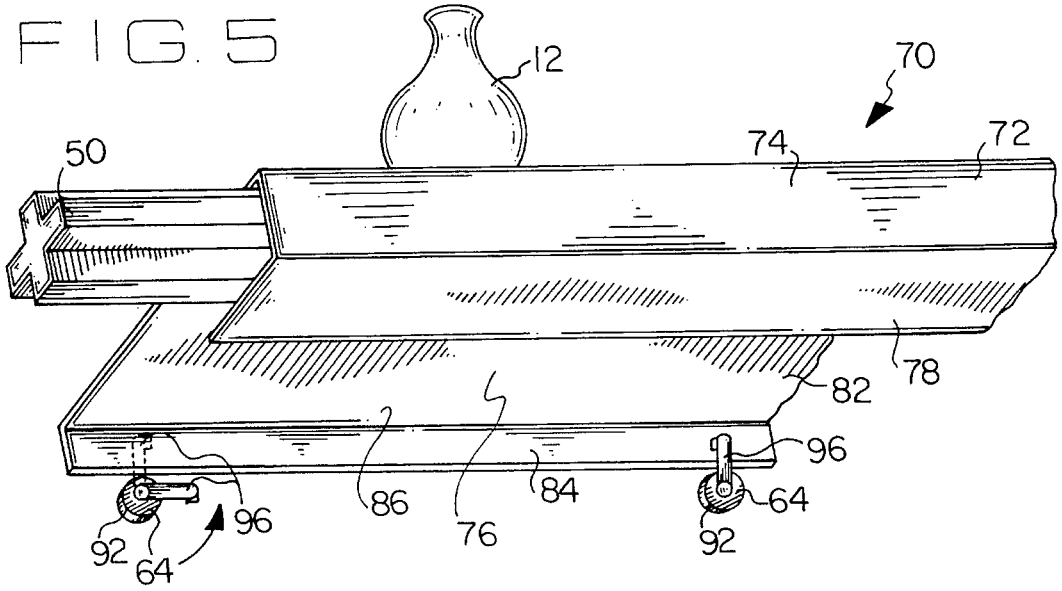
FIG. 5 is perspective view of the underside of a shelf structure mounted on a connecting rail and secured to a building wall with the shelf anchor means having the engaging arm portion.
Figure 6:
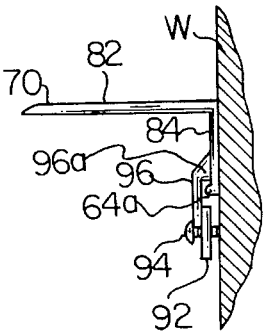
FIG. 6 is a side view of the preferred anchor means fitted over a shelf flange and flange bead.
Figure 7:
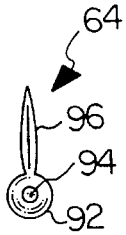
FIG. 7 is a front view of the anchor means of FIG. 6.
Figure 9:
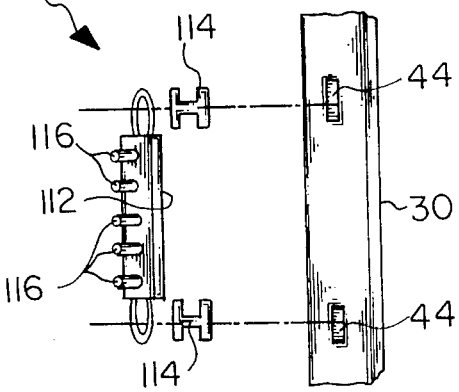
FIG. 9 is a perspective view of the tie rack optional accessory.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–10, a shelf system 10 is disclosed which is adjustable in size and configuration for efficient assembly within areas of various sizes and shapes such as closets and other interior building locations with minimal tools and hardware. See FIG. 1. Shelf system 10 is further adjusted to retain and support items 12 of various types and sizes.

System 10 preferably includes a mounting track 20 which is fastened substantially horizontally to the underside of an elevated structure 16 with fasteners 22 such as wood screws. See FIGS. 2 and 3. At least one, and preferably at least two, elongate suspension members 30 engage and hang downwardly from track 20, are spaced apart from each other, and preferably have a cross-sectional shape as shown in FIG. 2*a*. Metal reinforcing rods 48 are optionally included. At least one connecting rail 50 is secured from or between suspension members 30, for mounting coat hangers H or shelf structures 70. Where rails 50 are long enough to require additional support at their mid-sections, support means are provided such as mounting strap assemblies 52 which are anchored to track 20 or to the rail 50 immediately above the given rail 50, and are tied around the given rail 50. Wall anchoring means 64 are also provided.

Track 20 is preferably an elongate channel member 18 having a track top wall 24 and two spaced apart track side walls 26 extending longitudinally along and downwardly from track top wall 24. Retaining track flanges 28 extend toward each other from track side walls 26, spaced apart from and substantially parallel with track top wall 24. A longitudinal series of fastener ports 40 are provided along track 20 through which fasteners 22 pass to secure track 20 to an elevated structure 16.

Suspension members 30 are preferably elongate strips 32, each having an upper engaging end 34 with two opposing notches 36 removed to form a T-portion 38 at end 34. See FIGS. 3 and 4. T-portion 38 is sized to slide snugly and engagingly into track 20 by first orienting T-portion 38 to pass between flanges 28 and then rotating the suspension member 30 about its longitudinal axis to cause the ends of T-portion 38 to slide between flanges 28 and track top wall 24. The fit is preferably sufficiently snug that T-portion 38 actually snaps into and out of track 20 with T-portion 38 rotation.

A series of rail mounting ports 44 is provided along the length of each suspension member 30, preferably in the form of substantially rectangular holes oriented longitudinally with respect to the member 30. A machined recess 44*a* is preferably provided on either side of each mounting port 44 to permit T-portions 38 to snap into and out of place when rotated within a port 44. See FIG. 2*b*. Recesses 44*a* are contoured to have greater depth in the region where T-portions 38 immediately enter recesses 44*a*, for ease of T-portion 38 entry. Then recesses 44*a* become shallower and then deeper again to form a bulge over which the T-portion snaps to enter and to exit a recess 44*a*. Alternatively, a series of projecting knobs 42 are provided on the upper faces of flanges 28 or on the underside of top wall 24 so that a T-portion 38 snaps over a knob 42 into a space between knobs 42 to create a more secure engagement. See FIG. 2. Knobs 42 are spaced apart a distance equal to or greater than the thickness of T-portions 38. Track 20 material is resilient and deforms slightly during snap engagement and disengagement of a T-portion 38.

Rails 50 are preferably elongate members having cross-shaped cross-sections for minimal deflection under lateral loading. See FIGS. 3 and 5. At each rail 50 end, one of the intersecting cross-portions 52 is extended longitudinally to form a flat end segment 54. Opposing notches 56 are cut into end segments 54 to form T-portions 58 for engaging the rectangular rail mounting ports 44 in suspension members 30. T-portions 58 of each rail 50 are sized to pass through corresponding mounting ports 44 of equal elevation in opposing suspension members 30 when longitudinally aligned with ports 44, and to lockingly engage or disengage suspension member 30 upon a one quarter rotation of the rail 50 about its longitudinal axis to orient T-portions 58 across ports 44, or with ports 44, respectively. See FIGS. 3 and 4. Opposing notches 56 are sized to closely match the thickness of suspension members 30 at ports 44 so that T-portions 58 actually snap into and out of locking position when rotated relative to ports 44. To enhance the snap locking engagement, projecting knobs 62 are preferably provided on opposing sides of each port 44 so that a T-portion 58 snaps over knobs 62 when rotated for engagement or for disengagement. See FIG. 3. In this instance, T-portion 58 deflects slightly when sliding over a knob 62, and then resiliently reassumes its original shape.

Shelf structures 70 preferably include substantially U-shaped channel portions 72, each having a channel connecting wall 74 and an upper channel side wall 76 and a lower channel side wall 78 to function as a shelf mounting structure. See FIG. 5. Upper channel side wall 76 is substantially wider than lower channel side wall 78 to form a shelf portion 82 for supporting various items 12. The channel upper and lower side walls 78 and 76, respectively, are spaced apart a distance substantially matching the width of rails 50, so that channel portion 72 fits snugly around a given rail 50 and is retained in place by friction between channel portion 72 and the rail 50. When a shelf structure 70 is mounted on a rail 50, upper channel side wall 78 is positioned substantially horizontally and channel connecting wall 74 becomes the forward edge of the shelf structure 70. A shelf anchor flange 84 extends downwardly from the rearward edge 86 of the shelf portion 82 to lock behind wall anchor means 64, and a flange bead 64*a* is provided at the flange lower end.

Anchor means 64 preferably includes a flat, annular plate 92 through which a fastener 94 such as a wood screw is inserted into building wall W. An anchor flange engaging arm 96 projects radially from annular plate 92 for snugly fitting over flange 84, and an arm protrusion 96*a* extends over bead 64*a* against flange 64. See FIGS. 5, 6 and 7.

Connecting structures 100 are preferably constructed of a mount member 102 matching the top segment of the suspension member T-portion 38 in size and shape to fit snugly into track 20 in the same manner as the T-portion 38 does. An anchored end 98 of a hanger support strap 104 is secured to the mount member 102 and strap 104 extends downwardly from mount member 102. See FIGS. 4 and 8. Strap 104 is preferably a plastic tie strip similar to those used to bind together wires and hoses of automobile engines, and has a locking end 106 which fits through a locking band 108 encircling the strap 104.

A tie rack 110 is optionally provided with system 10. Rack 110 includes an elongate strip member 112 having suspension member port engaging tabs 114 and tab receiving loops 118 at both rack 110 ends, and having a longitudinal series of laterally protruding tie retaining pegs 116. See FIG. 9.

Figure 10:
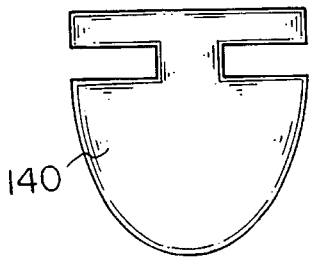
FIG. 10 is top view of the preferred notch marking template for forming properly sized and positioned notches in suspension members which are cut to a desired length by a consumer.

Track 20, suspension members 30, rails 50 and shelf structures 70 are preferably provided in kit form and in extended lengths for cutting to size by the installer as needed for a specific use. A notch template 140 is preferably provided as shown in FIG. 10, so that once suspension members 30 and rails 50 are cut to desired lengths, the opposing notches 36 and 56, respectively, of proper size may be cut into the ends 34 and 54 so that the interlocking engagement described above may be accomplished. As a result, system 10 is adjustable in overall height, rail 50 and shelf structure 70 length, and rail 50 and shelf structure 70 spacing, to occupy a specific space at a desired location and to retain items 12 of various specific sizes and types.

Method

In practicing the invention, the following method may be used. A method of assembling shelf system 10 is also provided. The user selects the dimensions of the space into which system 10 is to be assembled. Track 20 is fastened to an elevated structure 16 such as a closet ceiling. The T-portions 38 of two suspension members 30 are secured into track 20. See FIG. 2. The user selects the length of rail 50 and shelf structures 70 and cuts the rail 50 down to this length, and cuts notches 56 in end segment 54. The user also selects the elevation desired for a rail 50, and secures the T-portions 58 of the rail 50 into corresponding rail mounting ports 44 of suspension members 30 at that elevation. See FIGS. 3 and 4. The user decides whether the rail 50 is to support items 12 on hangers or free standing items 12. If the rail 50 is to support items 12 on hangers H, the user places the hooks of the hangers H over the rail 50 and hangs the items 12. If the rail 50 is to support free standing items 12, the user engagingly fits channel portion 72 of a shelf structure 70 around rail 50 such that channel upper side wall 78 is uppermost and horizontal. Finally, wall anchor means 64 are secured to the building wall W and to shelf anchor flange 84. A tie rack 110 or other accessory is optionally fitted to system 10.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A suspended shelf system for securing to an elevated structure for retaining various items, comprising:

a system mounting track member and means for securing said track member to said elevated structure, at least two suspension members, each having a suspension member mounting end with track member engaging means for securing each said suspension member to said track member, such that each said suspension member hangs substantially vertically from said track member, and such that said suspension members are spaced apart from each other, at least one connecting rail having two connecting rail ends, each said connecting rail end including suspension member engaging means, for mounting substantially horizontally between and engaging said spaced apart suspension members for retaining item hangers and shelf structures, wherein each said suspension member additionally comprises a plurality of connecting rail mounting ports recessed in a longitudinal series along the length of each said suspension member for receiving said suspension member engaging means, wherein each said connecting rail has two connecting rail ends, and each said suspension member engaging means includes a rail flat end segment extending longitudinally from the connecting rail, and wherein each said rail flat end segment includes a pair of opposing rail notches which define a rail T-portion at said rail end for engaging said rail mounting ports in said suspension members.

2. The shelf system of claim 1, wherein said track member includes an elongate channel portion having a track channel top wall, two spaced apart track channel side walls extending longitudinally along and downwardly from said track channel top wall, and two opposing track channel retaining flanges spaced apart from and substantially parallel with said track channel top wall and extending generally toward each other from said track channel side walls.

3. The shelf system of claim 2, wherein each said suspension member includes an elongate strip, said strip having two opposing notches removed to form a T-portion at said suspension member mounting end, said T-portion being sized to fit within said track member between said track channel retaining flanges and said track channel top wall.

4. The shelf system of claim 1, wherein each said connecting rail includes an elongate member having a cross-shaped cross-section for minimal bowing under lateral loading, said cross-section being formed of two intersecting cross portions, and wherein said rail flat end segment extends longitudinally and continuously from one of said cross-portions.

5. The shelf system of claim 4, wherein each said rail notch is sized to closely fit around the thickness of one of said suspension members at connecting rail said mounting ports.

6. The shelf system of claim 1, additionally comprising at least one said shelf structure, each said shelf structure including a shelf mounting portion comprising a substantially U-shaped shelf channel having a shelf channel connecting wall and a shelf channel upper side wall and a shelf channel lower side wall, said shelf channel upper side wall being sized in width to form a shelf surface for retaining at least one said item, said shelf channel upper and lower side walls being spaced apart a certain distance substantially matching the width of said rail member, such that said shelf channel fits snugly and engagingly around said connecting rail and is retained on said connecting rail by friction.

7. The shelf system of claim 1, additionally comprising connecting rail linking support means for linking said connecting rail to said track member above said connecting rail to prevent said connecting rail from sagging.

8. The shelf system of claim 7, wherein said connecting rail linking support means comprises a mounting strap assembly comprising:

a mount member for engagingly fitting into said track member, a hanger support strap extending from said mount member for securing around said connecting rail.

9. The shelf system of claim 1, additionally comprising a tie retaining rack comprising an elongate strip member having suspension member engaging means and having a longitudinal series of tie retaining pegs protruding from said elongate strip.

10. A method of assembling a shelf system into a space, said shelf system for securing to an elevated structure for retaining various items comprising a system mounting track member and means for securing said track member to said elevated structure, at least two suspension members comprising a plurality of connecting rail mounting ports recessed in a longitudinal series along the length of each said suspension member each said mounting port having a mounting port edge, each said suspension member having a suspension member mounting end with track member engaging means for securing each said suspension member to said track member, such that each said suspension member hangs substantially vertically from said track member, and such that said suspension members are spaced apart from each other, at least one connecting rail having two connecting rail ends, each said connecting rail end including suspension member engaging means comprising a rail flat end segment extending longitudinally from the connecting rail, and wherein each said rail flat end segment includes a pair of opposing rail notches which define a rail T-portion at said rail end for engaging said rail mounting ports in said suspension members, said connecting rail being for mounting substantially horizontally between and engaging said spaced apart suspension members for retaining item hangers and shelf structures, comprising the steps of:

selecting the dimensions of a space into which said shelf system is to be assembled, fastening said track member to said elevated structure, securing said suspension member mounting ends to said track member such that said suspension members are spaced apart from each other, selecting a desired elevation for a connecting rail in view of types of said items to be retained, positioning said connecting rail substantially horizontally between said suspension members, inserting a flat end segment of one said connecting rail into one of said connecting rail mounting ports in a suspension member and rotating said connecting rail substantially one quarter turn about the connecting rail longitudinal axis such that said opposing rail notches in said flat end segment receive the edge of the mounting port and the connecting rail thereby engages the suspension member.

11. The method of claim 10, comprising the additional step of:

selecting the types of said items to be retained by said shelf system.

12. The method of claim 11, wherein said shelf system additionally comprises an item hanger having a hook portion, comprising the additional step of:

placing said hook portion over said connecting rail and hanging at least one said item on said item hanger.

13. The method of claim 11, wherein said shelf system additionally comprises at least one said shelf structure, each said shelf structure including a shelf mounting portion comprising a substantially U-shaped shelf channel having a shelf channel connecting wall and a shelf channel upper side wall and a shelf channel lower side wall, said shelf channel upper side wall being sized in width to form a shelf surface for retaining at least one said item, said shelf channel upper and lower side walls being spaced apart a certain distance substantially matching the width of said rail member, such that said shelf channel fits snugly and engagingly around said connecting rail and is retained on said connecting rail by friction, comprising the additional step of:

fitting said shelf channel around said connecting rail such that said shelf channel upper side wall is substantially horizontal, to mount said shelf structure on said connecting rail.

14. The method of claim 10, comprising the additional step of cutting said opposing rail notches out of said flat end segments.

15. A suspended shelf system for securing to an elevated structure for retaining various items, comprising:

a system mounting track member and means for securing said track member to said elevated structure, at least two suspension members, each having a suspension member mounting end with track member engaging means for securing each said suspension member to said track member, such that each said suspension member hangs substantially vertically from said track member, and such that said suspension members are spaced apart from each other, and at least one connecting rail having two connecting rail ends, each said connecting rail end including suspension member engaging means, for mounting substantially horizontally between and engaging said spaced apart suspension members for retaining item hangers and shelf structures, wherein said track member includes an elongate channel portion having a track channel top wall, two spaced apart track channel side walls extending longitudinally along and downwardly from said track channel top wall, and two opposing track channel retaining flanges spaced apart from and substantially parallel with said track channel top wall and extending generally toward each other from said track channel side walls, wherein each said suspension member includes an elongate strip, said strip having two opposing notches removed to form a T-portion at said suspension member mounting end, said T-portion being sized to fit within said track member between said track channel retaining flanges and said track channel top wall, wherein each said suspension member additionally comprises a plurality of connecting rail mounting ports recessed in a longitudinal series along the length of each said suspension member for receiving said suspension member engaging means, wherein each said connecting rail includes an elongate member having a cross-shaped cross-section for minimal bowing under lateral loading, said cross-section being formed of two intersecting cross portions, wherein each said connecting rail has two rail ends, and each said suspension member engaging means includes a flat rail end segment extending longitudinally from one of said cross-portions, and wherein each said flat end includes a pair of opposing rail notches which define a rail T-portion at said rail end for engaging said rail mounting ports in said suspension members.

16. The shelf system of claim 13, wherein each said rail notch is sized to closely fit around the thickness of one of said suspension members at connecting rail said mounting ports.

17. A suspended shelf system for securing to an elevated structure for retaining various items, comprising:

a system mounting track member and means for securing said track member to said elevated structure, at least two suspension members, each having a suspension member mounting end with track member engaging means for securing each said suspension member to said track member, such that each said suspension member hangs substantially vertically from said track member, and such that said suspension members are spaced apart from each other, at least one connecting rail having two connecting rail ends, each said connecting rail end including suspension member engaging means, for mounting substantially horizontally between and engaging said spaced apart suspension members for retaining item hangers and shelf structures, and connecting rail linking support means for linking said connecting rail to said track member above said connecting rail to prevent said connecting rail from sagging, wherein said connecting rail linking support means comprises a mounting strap assembly comprising a mount member for engagingly fitting into said track member, a hanger support strap extending from said mount member for securing around said connecting rail.

18. A suspended shelf system for securing to an elevated structure for retaining various items, comprising:

a system mounting track member and means for securing said track member to said elevated structure, at least two suspension members, each having a suspension member mounting end with track member engaging means for securing said suspension members to said track member, such that each said suspension member hangs substantially vertically from said track member, and such that each said suspension member is spaced apart from each other, at least one connecting rail having two connecting rail ends, each said connecting rail end including suspension member engaging means, for mounting substantially horizontally between and engaging said spaced apart suspension members for retaining item hangers and shelf structures, wherein each said suspension member additionally comprises a plurality of connecting rail mounting ports recessed in a longitudinal series along the length of each said suspension member for receiving said suspension member engaging means, wherein each said connecting rail has two connecting rail ends, and each said suspension member engaging means includes a rail flat end segment extending longitudinally from the connecting rail, and wherein each said rail flat end segment includes at least one lateral rail notch for engaging said rail mounting ports in said suspension members.

* * * * *